US010096925B2

(12) United States Patent
Mukuno et al.

(10) Patent No.: US 10,096,925 B2
(45) Date of Patent: Oct. 9, 2018

(54) CONNECTOR

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Junichi Mukuno, Mie (JP); Kensaku Takata, Mie (JP); Kenichi Takata, Mie (JP)

(73) Assignees: AUTONETWORKS TECHNOLOGIES, LTD., Yokkaichi, Mie (JP); SUMITOMO WIRING SYSTEMS, LTD., Yokkaichi, Mie (JP); SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 0 days.

(21) Appl. No.: 15/735,333

(22) PCT Filed: May 30, 2016

(86) PCT No.: PCT/JP2016/065848
§ 371 (c)(1),
(2) Date: Dec. 11, 2017

(87) PCT Pub. No.: WO2016/203933
PCT Pub. Date: Dec. 22, 2016

(65) Prior Publication Data

US 2018/0175532 A1 Jun. 21, 2018

(30) Foreign Application Priority Data

Jun. 18, 2015 (JP) ..... 2015-122659

(51) Int. Cl.
*H01R 13/15* (2006.01)
*H01R 13/58* (2006.01)
(Continued)

(52) U.S. Cl.
CPC ..... *H01R 13/15* (2013.01); *H01R 13/2442* (2013.01); *H01R 13/58* (2013.01); *H01R 24/20* (2013.01)

(58) Field of Classification Search
CPC ..... H01R 13/2442; H01R 13/15
See application file for complete search history.

(56) References Cited

U.S. PATENT DOCUMENTS 5,271,740 A * 12/1993 Endo ..... H01R 12/57 439/260
5,676,562 A * 10/1997 Fukuda ..... H01R 12/79 439/329
(Continued)

FOREIGN PATENT DOCUMENTS

| | | |
|---|---|---|
| JP | 11-307209 | 11/1999 |
| JP | 2003-031194 | 1/2003 |
| JP | 2006-19242 | 1/2006 |

OTHER PUBLICATIONS

International Search Report dated Aug. 16, 2016.

*Primary Examiner* — Ross Gushi
(74) *Attorney, Agent, or Firm* — Gerald E. Hespos; Michael J. Porco; Matthew T. Hespos

(57) ABSTRACT

A connector (10) includes a body (14), a spring terminal (20) having a spring property and including a holding portion (20A) held in the body (14), a cantilever portion (20B) cantilevered from the body (14) and a connecting portion (20E) configured to be pressed into contact with and connected to a mating terminal (40) in a direction intersecting an extending direction of the cantilever portion (20B) by being bent from the cantilever portion (20B). A metal
(Continued)

member (16) is held in the body (14) and extends from the body (14) toward the cantilever portion (20B). An insulating member (50) is disposed on the metal member (16) so as to be between the cantilever portion (20B) and the metal member (16). The insulating member (50) includes a contact portion (50A) configured to contact the cantilever portion (20B) in the intersecting direction.

6 Claims, 3 Drawing Sheets

(51) Int. Cl.
*H01R 13/24* (2006.01)
*H01R 24/20* (2011.01)

(56) References Cited

U.S. PATENT DOCUMENTS 5,807,126 A * 9/1998 Bethurum ..... H01R 9/0515 439/259
6,007,359 A * 12/1999 Kosmala ..... H01R 23/70 439/329
6,079,988 A 6/2000 Hashiguchi et al.
6,257,899 B1 * 7/2001 Walkup ..... H01R 9/096 439/515
6,280,254 B1 * 8/2001 Wu ..... H01R 13/2442 439/515
6,491,552 B2 * 12/2002 Horikoshi ..... G06F 1/1616 361/785
6,589,082 B2 * 7/2003 Harasawa ..... H01R 13/2442 439/595
7,059,884 B2 * 6/2006 Hisaeda ..... H01R 13/20 439/329
7,153,173 B2 * 12/2006 Harasawa ..... H01R 13/2442 439/862
7,156,678 B2 * 1/2007 Feldman ..... H01R 4/024 439/326
7,179,134 B2 * 2/2007 Harasawa ..... H01R 13/2442 439/752
7,374,429 B2 * 5/2008 Cronch ..... H01R 12/79 439/496
7,862,360 B2 * 1/2011 Wang ..... H01Q 1/1271 439/326
9,160,089 B2 * 10/2015 Shimoji ..... H01R 12/7082
9,887,479 B2 * 2/2018 Mukuno ..... H01R 13/2428
2002/0077002 A1 * 6/2002 Harasawa ..... H01R 13/2442 439/862
2005/0112928 A1 * 5/2005 Funatsu ..... H01R 13/453 439/326
2006/0003634 A1 1/2006 Jeong
2011/0063186 A1 * 3/2011 Park ..... H01Q 1/12 343/892
2015/0024640 A1 * 1/2015 Yamada ..... H01R 13/2442 439/786

* cited by examiner

CONNECTOR

BACKGROUND

Field of the Invention

This specification relates to a connector.

Description of the Related Art

Japanese Unexamined Patent Publication No. H11-307209 discloses a connector that includes a cantilevered spring terminal having a spring property and a body for holding the spring terminal. The spring terminal is pressed into contact with a mating terminal to electrically connect the terminals. The connector may have a contact serving as the spring terminal configured to contact an electrical component and to be connected to the electrical component by being resiliently deformed. The connector also may have an insulator serving as a body having the contact mounted therein.

The above-described spring terminal that is pressed into contact with the mating terminal is subject to a stress caused by a load exerted to a part of the body for holding the spring terminal. Thus, for example, if the body is made of resin, the stress causes a creep deformation amount of the part of the body for holding the spring terminal. A deformation amount of the resin with the passage of time has been large when the spring terminal is pressed into contact with the mating terminal, and the load applied to the spring terminal when the spring terminal is pressed into contact with the mating terminal has been unstable in a high-temperature environment.

This specification was created in view of the above problem and aims to stabilize a load applied to a spring terminal.

SUMMARY

This specification is directed to a connector with a body and a spring terminal having a spring property. The spring terminal has a holding portion held in the body, a cantilever portion cantilevered from the body and a connecting portion configured to be pressed into contact with and connected to a mating terminal in a direction intersecting an extending direction of the cantilever portion by being bent from the cantilever portion. A metal member is held in the body and extends from the body toward the cantilever portion. An insulating member having an insulating property is disposed on the metal member in such a manner as to be interposed at least between the cantilever portion and the metal member. The insulating member includes a contact portion configured to contact the cantilever portion in the intersecting direction.

In the above connector, the contact portion of the insulating member contacts the cantilever portion of the spring terminal in the same direction as a direction in which the connecting portion of the spring terminal is pressed into contact with the mating terminal. Thus, when the connecting portion of the spring terminal is pressed into contact with the mating terminal, the contact portion of the insulating member receives, from the cantilever portion of the spring terminal, a stress caused by a load applied from the connecting portion in the same direction as a direction of the load, and the load received by the insulating member is taken up by the metal member via the insulating member. As a result, the application of the stress caused by the load to the holding portion of the spring terminal is suppressed and a creep deformation amount in the holding portion is suppressed. Thus, the load applied to the spring terminal can be stabilized.

In the above connector, a surface of the insulating member facing toward the cantilever portion may be a curved surface bulging toward the cantilever portion. According to this configuration, the contact portion of the insulating member can easily contact the cantilever portion of the spring terminal. Thus, when the connecting portion of the spring terminal is pressed into contact with the mating terminal, the contact portion of the insulating member can easily receive a stress caused by a load applied to the connecting portion and the creep deformation amount in the holding portion of the spring terminal can be suppressed.

A surface of the insulating member facing toward the cantilever portion may be a flat surface, and the contact portion may come into surface contact with the cantilever portion. According to this configuration, substantially all of the contact portion of the insulating member can be brought into contact with the cantilever portion of the spring terminal. As a result, when the connecting portion of the spring terminal is pressed into contact with the mating terminal, the contact portion of the insulating member can easily receive a stress caused by a load applied to the connecting portion and the creep deformation amount in the holding portion of the spring terminal can be suppressed.

The spring terminal may be formed by bending a leaf springA part of the metal member where the insulating member is disposed may be plate-like and the metal member may be disposed such that plate surfaces of the part thereof where the insulating member is disposed are parallel to plate surfaces of the cantilever portion.

According to this configuration, since a stress received by the insulating member is uniformly applied to a part of the metal member overlapping with the cantilever portion via the insulating member. This stress can be taken up easily by the metal member via the insulating member.

The insulating member may be disposed to sandwich the plate-like part of the metal member and may be mounted on a plate surface of the plate-like part opposite to the one facing toward the cantilever portion. Thus, a specific configuration for mounting the insulating member on the metal member can be provided.

The insulating member may be an insulating paper. Accordingly, the insulating member is less likely to be affected by an environmental temperature and the like, for example, as compared to the case where the insulating member is a member made of synthetic resin. Thus, the creep deformation amount in the holding portion of the spring terminal can be suppressed.

According to the specification, it is possible to stabilize a load applied to a spring terminal.

DETAILED DESCRIPTION

A motor-side connector (an example of a connector) 10 constituting a connection device 1 for electrically connecting an unillustrated inverter and an unillustrated motor, for example, in a hybrid or electric vehicle is illustrated in this embodiment.

Note that X, Y and Z axes orthogonal to each other are shown in each figure and each axis direction is shown to be a corresponding direction in each figure. The X-axis direction coincides with a lateral direction of the motor-side connector 10 with a direction toward a right side in FIG. 2 as a rightward direction, the Y-axis direction coincides with a front-rear direction of the motor-side connector 10 with a direction toward a right side in FIG. 3 as a forward direction and the Z-axis direction coincides with a vertical direction of the motor-side connector 10 with a direction toward an upper side in FIGS. 1 and 3 as an upward direction.

Figure 1:
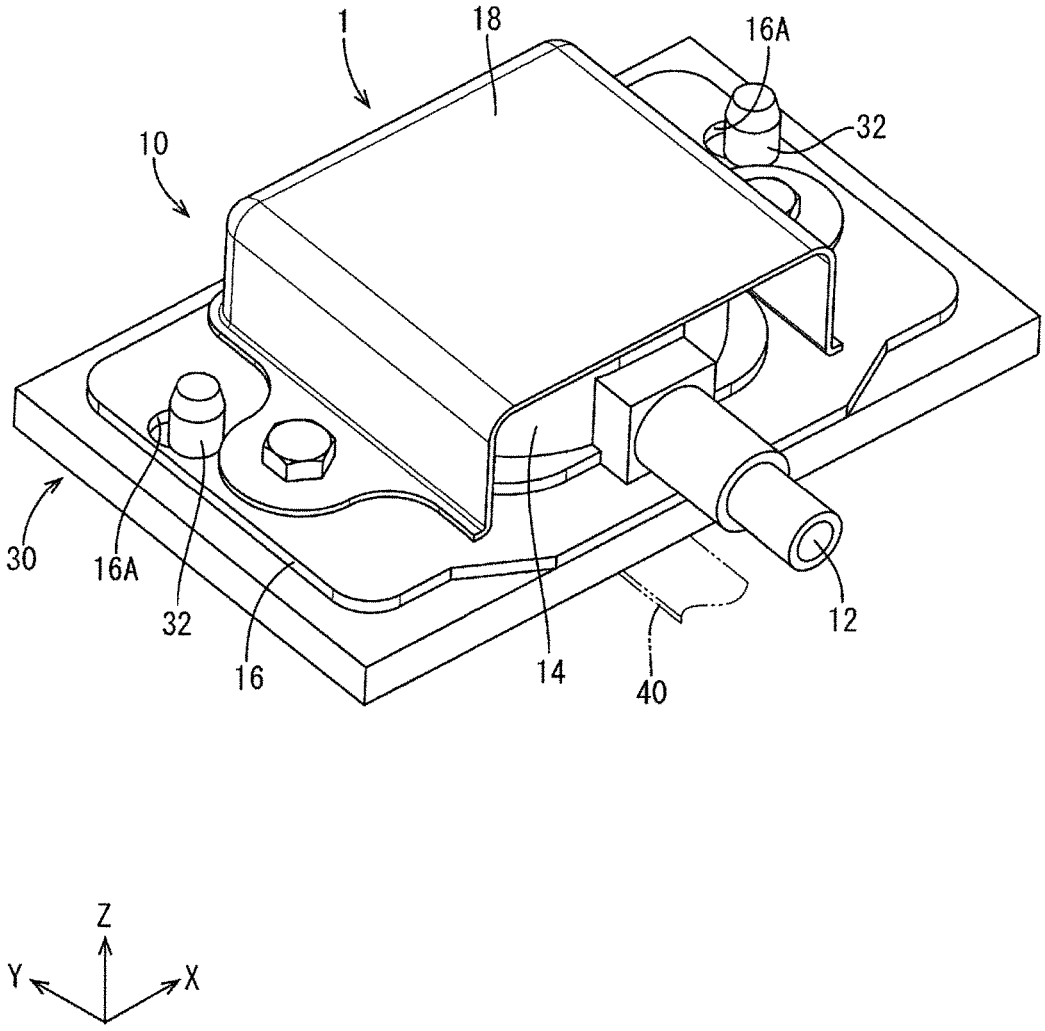
FIG. 1 is a perspective view of a connection device including a motor-side connector according to an embodiment.

As shown in FIG. 1, the connection device 1 includes the motor-side connector 10. A cable 12 is held in the motor-side connector 10 and has a first end to be connected electrically to a motor. A motor-side terminal 20 extends down from the second end of the cable 12. An inverter-side connector 30 is to be assembled with the motor-side connector 10 and an inverter-side terminal (an example of a mating terminal) 40 is to be connected electrically to an inverter. Note that an upper side is a motor side and a lower side is an inverter side in each figure.

The motor-side connector 10 is mounted on an outer surface of an unillustrated motor case for accommodating the motor, and the inverter-side connector 30 is mounted on the outer surface of an unillustrated inverter case for accommodating the inverter so as to face the motor-side connector 10. The inverter-side terminal 40 extends from the inverter and is disposed below the inverter-side connector 30 and exposed up through an inverter-side opening 30A (see FIG. 3). The connection device 1 electrically connects the motor-side terminal 20 and the inverter-side terminal 40 by assembling the motor-side connector 10 and the inverter-side connector 30.

Figure 2:
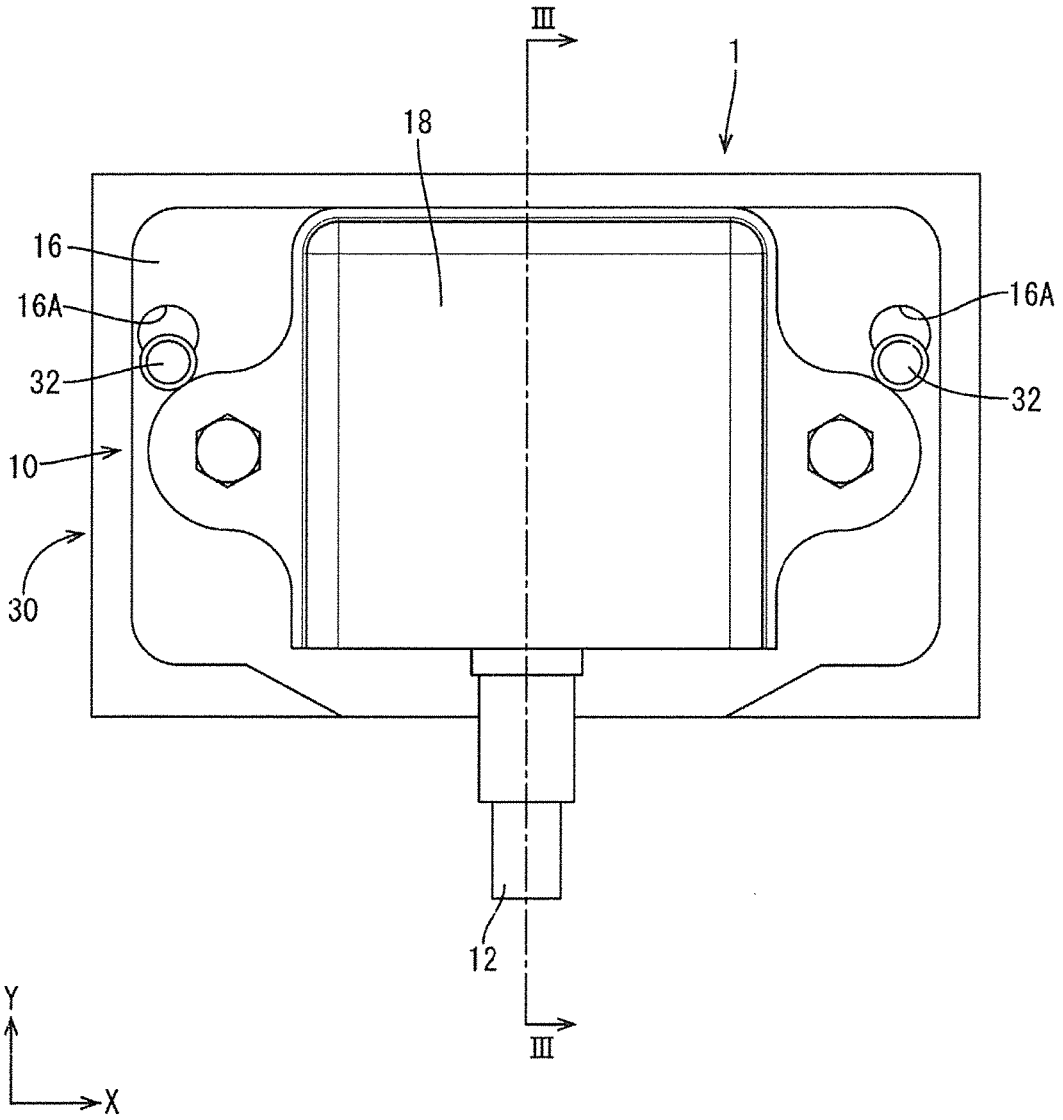
FIG. 2 is a plan view of the connection device including the motor-side connector.

The inverter-side connector 30 is made of synthetic resin and is substantially in the form of a flat plate, as shown in FIGS. 1 and 2. The inverter-side connector 30 is provided with the inverter-side opening 30A (see FIG. 3) that opens in the vertical direction and a deformation preventing portion 30C (see FIG. 3).

The inverter-side opening 30A has an opening size so that the inverter-side terminal 40 is exposed up with the inverter-side connector 30 mounted on the inverter case. Unillustrated inverter-side bold holes are provided at positions overlapping with unillustrated motor-side bolt holes on four corners of the inverter-side connector 30 when the motor-side connector 10 and the inverter-side connector 30 are assembled. The deformation preventing portion 30C is slightly above a connecting portion 20E of the motor-side terminal 20 to correspond to the inverter-side terminal 40 and the motor-side terminal 20 to be described later.

The inverter-side terminal 40 is a rigid plate-like busbar and extends in the front-rear direction with plate surfaces thereof substantially parallel to an X-Y plane. The one end part of the inverter-side terminal 40 is connected to the inverter, as described above, and the other end part thereof is exposed up through the inverter-side opening 30A. Note that the inverter-side terminal 40 is rigid and difficult to deflect even if the connecting portion 20E of the motor-side terminal 20 is pressed into contact therewith.

Next, the configuration of the motor-side connector 10 is described in detail. As shown in each figure, the motor-side connector 10 has a body 14 made of synthetic resin, a thin frame-like iron plate (an example of a metal member) 16 and a cover 18 mounted on the body 14 to cover the motor-side terminal 20 from above. The body 14 is a short tube that opens in the vertical direction. The iron plate 16 is held in the body 14 and is integrated with the body 14 by insert molding. The cable 12 extends in the front-rear direction and is supported in the body 14.

Potbelly holes 16A vertically penetrate left and right side parts of the iron plate 16. Positioning pins 32 mounted on the inverter-side connector 30 are inserted into these potbelly holes 16A, and the iron plate 16 is slidably locked to the inverter-side connector 30 by relatively sliding in the front-rear direction along the potbelly holes 16A with respect to the inverter-side connector 30 from a state where the positioning pins 32 are inserted in the potbelly holes 16A.

A mounting portion 18A to be mounted into the body 14 is provided on the inner surface (downward facing surface) of the cover 18. The cover 18 has both left and right side parts thereof mounted on the body 14 by bolting and has the mounting portion 18A mounted in an upper opening of the body 14. Note that the mounting portion 18A is held in close contact with the inner peripheral surface of the opening of the body 14 via a seal ring.

Figure 3:
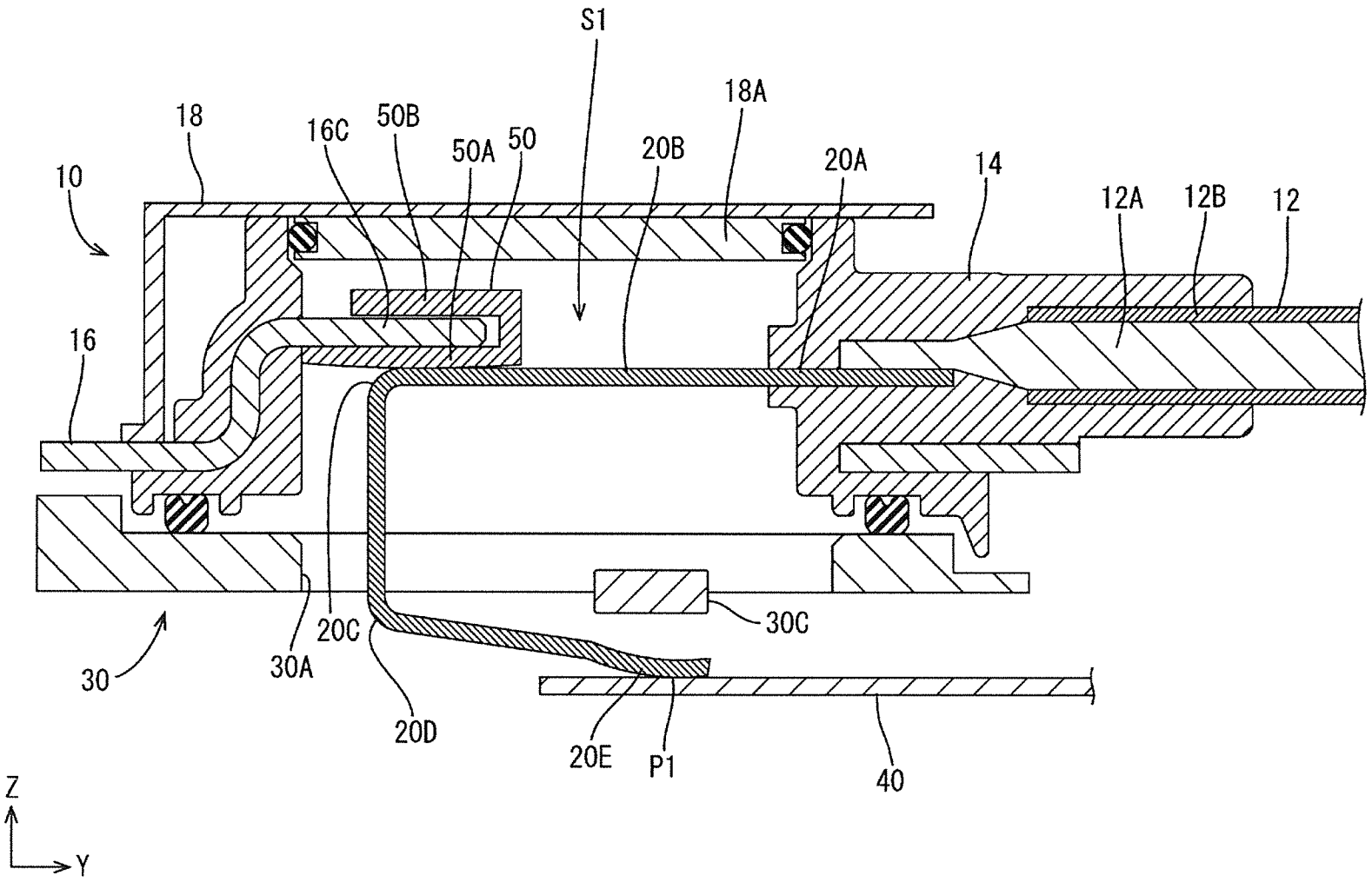
FIG. 3 is a section showing a cross-sectional configuration along in FIG. 2.

As shown in FIG. 3, the cable 12 supported in the body 14 is composed of a core 12A and an insulation coating 12B covering the core 12A, and an end thereof is embedded in the body 14. The core 12A is exposed from the insulation coating 12B at the end of the cable 12 embedded in the body 14.

The motor-side terminal 20 is formed by bending a leaf spring and has a spring property. As shown in FIG. 3, a holding portion 20A is formed at one end part of the motor-side terminal 20 and is held and embedded in the body 14. The motor-side terminal 20 is connected electrically to the core 12A exposed at the end of the cable 12 in this holding portion 20A.

As shown in FIG. 3, the motor-side terminal 20 includes a cantilever portion 20B cantilevered straight rearward from the body 14 (holding portion 20A) in a space S1 inside the body 14 with plate surfaces thereof facing in the vertical direction. A first bent portion 20C is bent down from a leading end part of the cantilever portion 20B, a second bent portion 20D is bent somewhat to a front-lower side from a leading end part of the first bent portion 20C. The connecting portion 20E extends from the second bent portion 20D and is to be connected to the inverter-side terminal 40 by a leading end part thereof being pressed into contact with the inverter-side terminal 40.

The connecting portion 20E of the motor-side terminal 20 is pressed into contact with a leading end part of the inverter-side terminal 40 from above at a contact point P1 thereof, as shown in FIG. 3, by assembling the inverter-side connector 30 and the motor-side connector 10. Thus, the connecting portion 20E is pressed into contact with the inverter-side terminal 40 in the vertical direction, i.e. in a direction intersecting with an extending direction (front-rear direction) of the cantilever portion 20B.

The connecting portion 20E of the motor-side terminal 20 is pressed into contact with the inverter-side terminal 40, and the connecting portion 20E receives an upward load from the inverter-side terminal 40 due to a reaction force. When the connecting portion 20E receives a load from the inverter-side terminal 40, a stress caused by that load is transmitted to the cantilever portion 20B via the second and first bent portions 20D, 20C.

Note that the deformation preventing portion 30C of the inverter-side connector 30 described above is provided to prevent the deformation of the connecting portion 20E of the motor-side terminal 20. Specifically, when being excessively pressed up, the upwardly pressed connecting portion 20E interferes with the deformation preventing portion 30C (see FIG. 3). This prevents the connecting portion 20E of the motor-side terminal 20 from being deformed into an upwardly bent shape.

In this embodiment, a rear part of the iron plate 16 embedded in the body 14 is bent in the body 14 and the iron plate 16 extends into the space S1 inside the body 14 from the body 14 toward the cantilever portion 20B of the motor-side terminal 20 (hereinafter, a part of the iron plate 16 located in the space S1 inside the body 14 is referred to as an "extending portion 16C") as shown in FIG. 3. The extending portion 16C extends in the front-rear direction with both plate surfaces thereof facing in the vertical direction, and a part thereof is located slightly above a rear end part (part near the first bent portion 20C) of the cantilever portion 20B in the motor-side terminal 20 with a tiny clearance defined therebetween.

As shown in FIG. 3, an insulating member 50 having a substantially U-shaped cross-section is disposed above the extending portion 16C of the iron plate 16 to sandwich the both plate surfaces of the extending portion 16C. The insulating member 50 is made of synthetic resin and has an insulating property. A part of the insulating member 50 located below the extending portion 16C defines a contact portion 50A configured to contact the cantilever portion 20B by entering a clearance between the extending portion 16C and the cantilever portion 20B. Note that since the contact portion 50A interposed between the extending portion 16C and the cantilever portion 20B has an insulating property as described above, no short circuit occurs between the motor-side terminal 20 and the iron plate 16.

The contact portion 50A of the insulating member 50 contacts the cantilever portion 20B in the vertical direction (direction intersecting with the extending direction of the cantilever portion 20B) by being located above the cantilever portion 20B. Further, the lower surface (surface facing toward the cantilever portion 20B) of the contact portion 50B bulges slightly toward the cantilever portion 20B, as shown in FIG. 3. This makes it easier for the contact portion 50A to contact the cantilever portion 20B.

On the other hand, a part of the insulating member 50 located above the extending portion 16C defines an attaching portion 50B attached to the upper surface (plate surface opposite to the one facing toward the cantilever portion 20B) of the extending portion 16 by an unillustrated lance structure.

The contact portion 50A of the insulating member 50 contacts the cantilever portion 20B of the motor-side terminal 20 in a direction in which the connecting portion 20E of the motor-side terminal 20 is pressed into contact with the inverter-side terminal 40, i.e. in the vertical direction. Thus, when the connecting portion 20E of the motor-side terminal 20 is pressed into contact with the inverter-side terminal 40 by assembling the motor-side connector 10 with the inverter-side connector 30, the contact portion 50A of the insulating member 50 receives a stress caused by a load applied from the inverter-side terminal 40 to the connecting portion 20E in the same direction as the direction of the load, i.e. in the upward direction from the cantilever portion 20B of the motor-side terminal 20.

When the insulating member 50 receives the stress from the cantilever portion 20B, that stress is taken up by the extending portion 16C of the iron plat 16 via the insulating member 50. As a result, the application of the stress caused by the load to the holding portion 20A of the motor-side terminal 20 is suppressed and a creep deformation amount in the holding portion 20A is suppressed. Thus, a load applied to the motor-side terminal 20 when the motor-side terminal 20 is pressed into contact with the inverter-side terminal 40 can be stabilized.

The plate surfaces of the extending portion 16C of the iron plate 16 are facing in the vertical direction. Thus, the plate surfaces of the extending portion 16C are parallel to those of the cantilever portion 20B. By employing this configuration, a stress received by the contact portion 50A of the insulating member 50 is applied uniformly to a part of the iron plate 16 overlapping with the cantilever portion 20B via the insulating member 50, i.e. the extending portion 16C. Thus, this stress easily can be taken up by the iron plate 16 via the insulating member 50.

Modifications of the above embodiment are listed below.

Although the insulating member made of synthetic resin is illustrated in the above embodiment, a material constituting the insulating member is not limited. For example, the insulating member may be made of insulating paper. In this case, the insulating member is less likely to be affected by an environmental temperature and the like as compared to the case where the insulating member is a member made of synthetic resin. Thus, the creep deformation amount in the holding portion of the spring terminal can be effectively suppressed.

Although the lower surface of the contact portion is illustrated to be a curved surface bulging toward the cantilever portion in the above embodiment, the shape of the lower surface of the contact portion is not limited. For example, the lower surface of the contact portion may be a flat surface and the contact portion may come into surface contact with the cantilever portion. In this case, the contact portion of the insulating member can be substantially entirely brought into contact with the cantilever portion. As a result, when the connecting portion of the motor-side terminal is pressed into contact with the inverter-side terminal, the contact portion of the insulating member can easily receive a stress caused by a load applied to the connecting portion and the creep deformation amount in the holding portion of the motor-side terminal can be effectively suppressed.

Although the motor-side terminal is illustrated to include two bent portions in the above embodiment, how to bend the motor-side terminal is not limited. For example, the motor-side terminal may be bent into a substantially V shape in a sectional view.

Although the extending portion is illustrated to extend from the rear part of the iron plate in the above embodiment, the position of the extending portion is not limited. For example, the extending portion may be configured to extend downward from the cover member made of metal toward the cantilever portion.

Although the motor-side connector is illustrated as an example of the connector in the above embodiment, the teaching disclosed in this specification can be applied also to connectors other than motor-side connectors.

Although the embodiments have been described in detail above, these are merely illustrative and not intended to limit claims. A technique described in claims includes various modifications and changes of the specific example illustrated above.

LIST OF REFERENCE SIGNS

1 . . . connection device
10 . . . motor-side connector
12 . . . cable

14 . . . body
16 . . . iron plate
16C . . . extending portion
18 . . . cover
20 . . . motor-side terminal
20A . . . holding portion
20B . . . cantilever portion
20C . . . first bent portion
20D . . . second bent portion
20E . . . connecting portion
30 . . . inverter-side connector
32 . . . positioning pin
40 . . . inverter-side terminal
50 . . . insulating member
50A . . . contact portion
50B . . . attaching portion
P1 . . . contact point
S1 . . . space

The invention claimed is:

1. A connector, comprising:

a body;

a spring terminal having a spring property and including a holding portion held in the body, a cantilever portion cantilevered from the body and a connecting portion configured to be pressed into contact with and connected to a mating terminal in a direction intersecting with an extending direction of the cantilever portion by being bent from the cantilever portion;

a metal member, held in the body and extending from the body toward the cantilever portion; and an insulating member having an insulating property and disposed on the metal member in such a manner as to be interposed at least between the cantilever portion and the metal member;

the insulating member including a contact portion configured to contact the cantilever portion in the intersecting direction.

2. The connector of claim 1, wherein a surface of the insulating member facing toward the cantilever portion is a curved surface bulging toward the cantilever portion.

3. The connector of claim 1, wherein:

a surface of the insulating member facing toward the cantilever portion is a flat surface; and the contact portion comes into surface contact with the cantilever portion.

4. The connector of claim 1, wherein:

the spring terminal is formed by bending a leaf spring; and a part of the metal member where the insulating member is disposed is plate-like and the metal member is disposed such that plate surfaces of the part thereof where the insulating member is disposed are parallel to plate surfaces of the cantilever portion.

5. The connector of claim 4, wherein the insulating member is disposed to sandwich the plate-like part of the metal member and mounted on a plate surface of the plate-like part opposite to the one facing toward the cantilever portion.

6. The connector of claim to 1, wherein the insulating member is an insulating paper.

* * * * *